US007282018B2

(12) United States Patent
Priest, III

(10) Patent No.: US 7,282,018 B2
(45) Date of Patent: Oct. 16, 2007

(54) CENTRIFUGAL RECEPTACLE DRAINER

(76) Inventor: Charles William Priest, III, 5375 Marsala La., Jacksonville, FL (US) 32244

( * ) Notice: Subject to any disclaimer, the term of this patent is extended or adjusted under 35 U.S.C. 154(b) by 22 days.

(21) Appl. No.: 10/907,267

(22) Filed: Mar. 26, 2005

(65) Prior Publication Data

US 2006/0214079 A1 Sep. 28, 2006

(51) Int. Cl.
*B04B 5/02* (2006.01)

(52) U.S. Cl. ..... 494/16

(58) Field of Classification Search ..... 494/16, 494/20, 31, 33, 43, 85
See application file for complete search history.

(56) References Cited

U.S. PATENT DOCUMENTS

| | | | | |
|---|---|---|---|---|
| 2,536,419 | A | 1/1951 | Brunell et al. | |
| 4,217,941 | A | 8/1980 | Catalano | |
| 4,306,676 | A * | 12/1981 | Edwards et al. | 494/16 |
| 4,399,847 | A | 8/1983 | McRoberts | |
| 4,586,918 | A * | 5/1986 | Cole | 494/20 |
| 4,820,257 | A * | 4/1989 | Ishimaru | 494/16 |
| 5,080,150 | A | 1/1992 | Deadwyler, Jr. | |
| 5,665,047 | A * | 9/1997 | Brimhall | 494/16 |
| 5,794,671 | A | 8/1998 | Smith | |
| 6,045,494 | A * | 4/2000 | Toyama | 494/16 |
| 6,390,965 | B1 * | 5/2002 | Matsushima | 494/16 |
| 6,811,531 | B2 * | 11/2004 | Moscone, Sr. | 494/20 |
| 2005/0277538 | A1 * | 12/2005 | Sherman et al. | 494/16 |

FOREIGN PATENT DOCUMENTS

| | | | |
|---|---|---|---|
| WO | 97/22413 | A1 * | 6/1997 |
| WO | 2004/045774 | A1 * | 6/2004 |

* cited by examiner

*Primary Examiner*—Charles E. Cooley

(57) ABSTRACT

A draining apparatus for collecting fluids from a container. This device consists essentially of a base and a rotational receptacle support, which holds and rotates, the container, which is to be drained. The container is held in a nearly horizontal position with the container opening oriented outward and is rotated at high speed so that sufficient centrifugal force is developed to empty the contents. The contents are emptied into a collector, which allows for convenient transfer to a second container using a syringe type plunger.

6 Claims, 8 Drawing Sheets

CENTRIFUGAL RECEPTACLE DRAINER

This invention pertains to a machine for extracting a residue of liquid from the inside of a container.

Specifically, this invention describes an apparatus that enables the rapid collection and re-introduction of viscous liquids from and to a container. This invention addresses the removal and insertion of typical liquids such as ketchup, mayonaise, syrup, salad dressing, puddings, mustard, steak sauces, hair gels, etc.

BACKGROUND OF THE INVENTION

Viscous fluids are commonly stored in containers that have a narrow or otherwise difficult to access neck. For example, a ketchup bottle features a slender neck and one cannot easily insert a spoon or other utensil for means of helping to empty the bottle completely. As a result, the user will discard the bottle and its residual contents in order to save time and frustration.

In contrast, there are individuals and businesses that see it as being more economical to reclaim as much as is possible of the remaining residue left in such bottles. As an example, a common practice in the restaurant industry is to "marry" the ketchup bottles by collecting the remaining residue and consolidating it into one container. After enough residue is collected, it is then used to "top off" other partially filled ketchup bottles. This results in significant savings of money wasted by leftover residue being discarded with the ketchup bottle. Another reason for "marrying" ketchup bottles is that a full ketchup bottle is more appealing to the customer than a partially full bottle.

In the past, machines and fixtures have been invented for the purpose of capturing leftover residues from the insides of containers. The problem with most of these previous inventions is that they are simply fixtures for holding containers in an inverted position, thereby allowing gravity to act as the primary means of motivating the residue out.

U.S. Pat. No. 5,080,150 is simply a basket that lets consumers invert and fully drain thick liquid condiment bottles so the product flows into the neck and against the inside of the cap ready for immediate use.

SUMMARY OF THE INVENTION

This invention is an improvement over known receptacle drainers because it provides a more economical and efficient means for recovering liquid residues from narrow-necked containers and provides a more effective and efficient means of introducing liquid residues into narrow-necked containers. Also, the drainer portion of this invention has a broad application as it will accept receptacles of various shapes and volumes.

This invention also provides for easy cleaning as the receptacle support, support retainer and support frame disassemble from the base frame and can be safely washed in all commercial dishwashers used by the service industry.

In its broadest aspects, this invention provides for the draining of fluids from a receptacle. Structurally, it is comprised of a base frame, a rotating receptacle support frame coupled to said base frame vertical drive shaft, one or more receptacle supports which is mounted into rotating receptacle support frame surrounded by a safety shroud and topped with a safety lid.

According to one embodiment, the base frame houses a mounted electric motor which turns a vertical drive shaft, which turns the rotating receptacle support frame coupled to the drive shaft.

In another embodiment, the base frame houses a mounted transmission, which is operated by an externally mounted hand crank. The transmission turns a vertical drive shaft, which turns the rotating receptacle support frame coupled to the drive shaft.

A preferred form of the base frame provides for a pluralty of supporting legs, the ends of which include a locking caster wheel. The base frame includes a safety shroud and lid for protecting the operator from rotating components.

A preferred form of the rotating receptacle support frame includes cut-outs that are form-fitted to specially retain the receptacle supports. The receptacle support frame includes a keyed hole located in the center for accommodating a matching drive shaft. The receptacle support(s) are retained in the cut-outs by a single central retainer which slides over the drive shaft end and secures the receptacle support(s) to the rotating receptacle support frame by sandwiching the innermost, bottom bore lip between the retainer and the rotating receptacle support frame.

This invention will now be described with particularity by reference to the Drawings.

DESCRIPTION OF THE PREFERRED EMBODIMENTS

Figure 1:
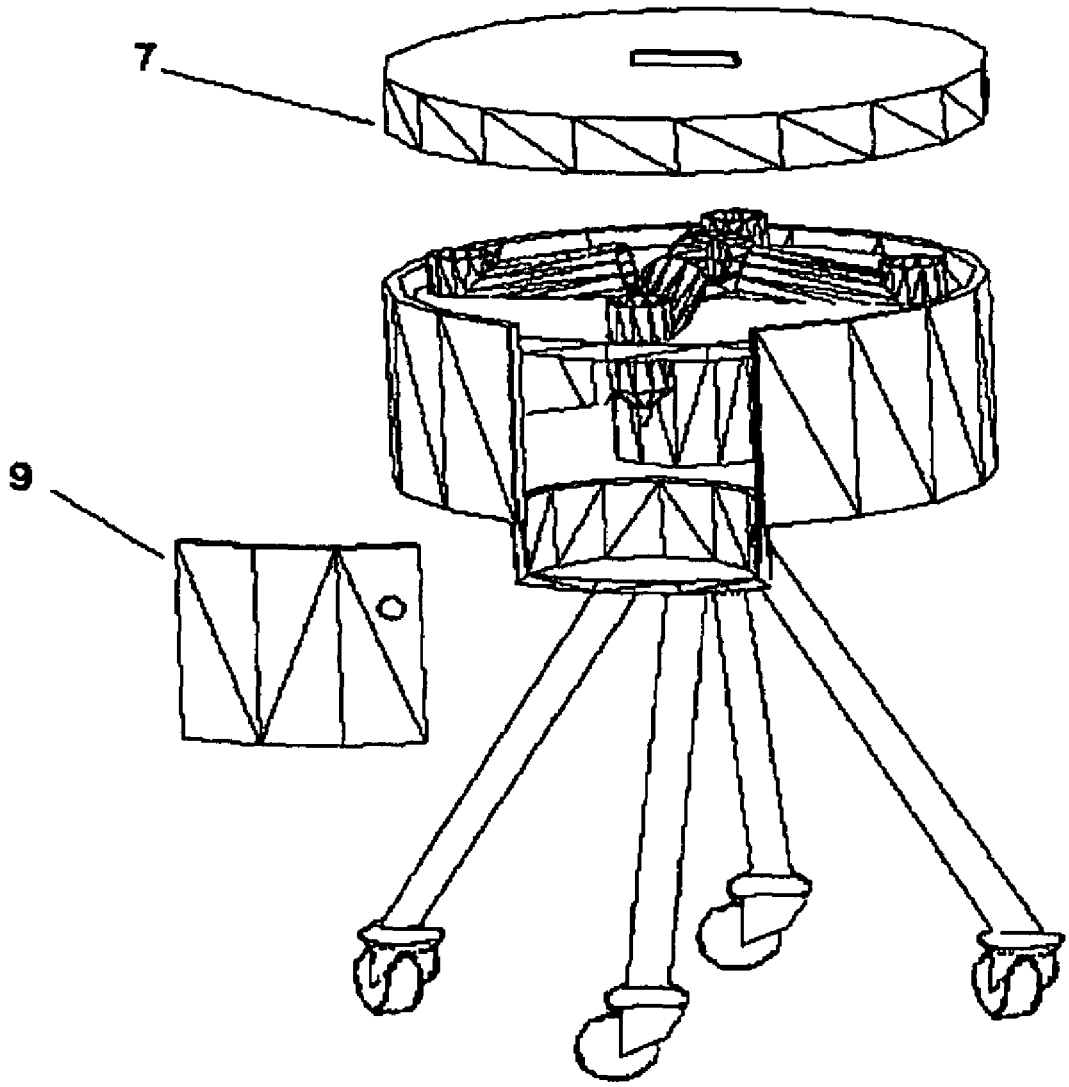
FIG. 1 is a perspective view of a drainer assembly according to this invention.
Figure 2:
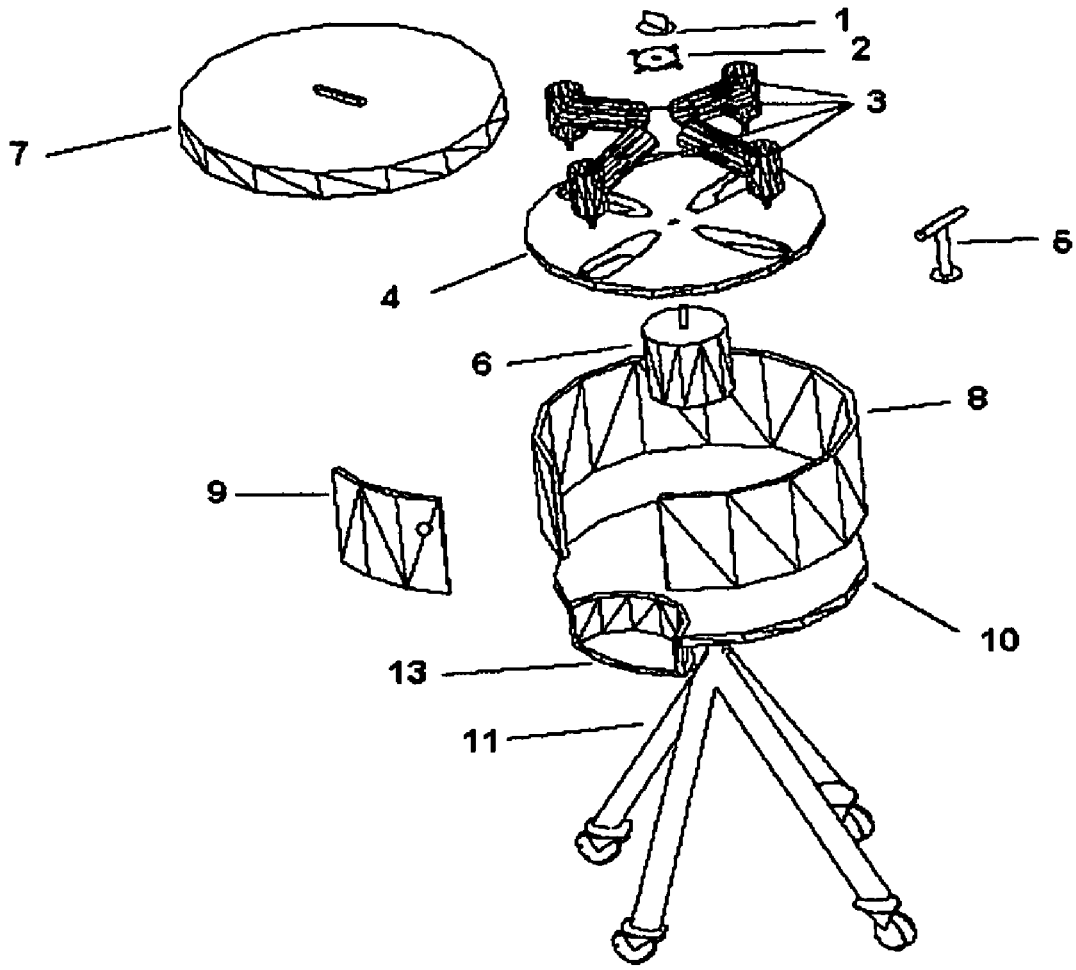
FIG. 2 is an exploded perspective view of the drainer assembly shown in FIG. 1.

FIG. 1 is a perspective view of a first embodiment of the present invention. FIG. 2 is an exploded view of the assembly depicted in FIG. 1. This embodiment is comprised of a base frame 10, receptacle support frame 4, receptacle supports 3, a plunger 5 and a receptacle support retainer 2. The base frame 10 features a shelf 13, which can be used to support a second empty or partially filled receptacle underneath a receptacle support. This enables the contents of the receptacle support to be easily syringed into the second receptacle by use of the plunger 5. The base frame is supported by support legs 5 for vibration dampening and easy mobility of unit.

The receptacle support frame 4 features a round, rotable disk that incorporates shaped holes that accept the receptacle support(s) 3. The center bore of the disk is keyed so as not to allow the disk to slip on the motor 6 drive shaft.

Figure 3:
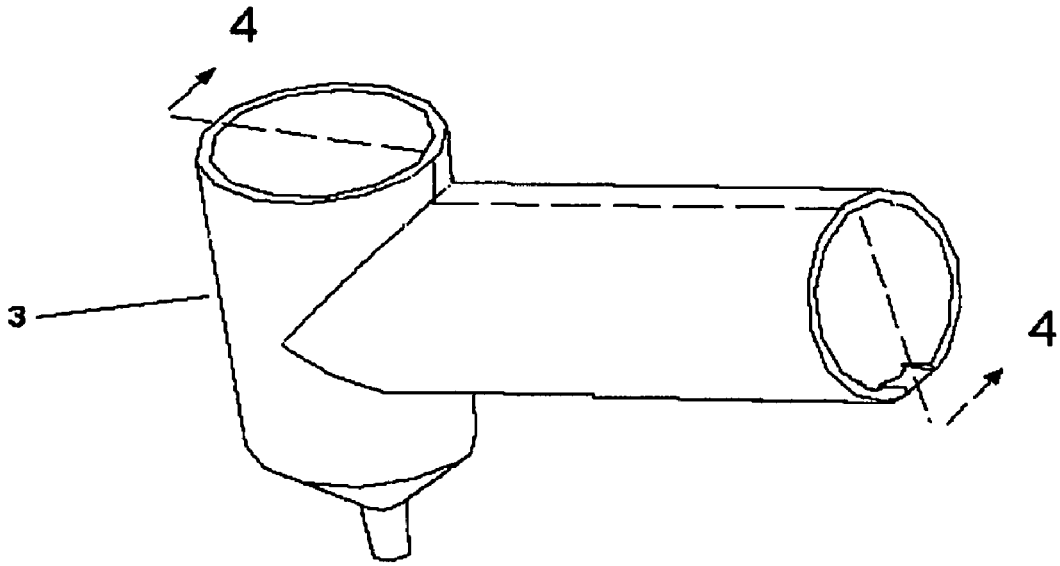
FIG. 3 is a perspective view of the receptacle support.
Figure 4:
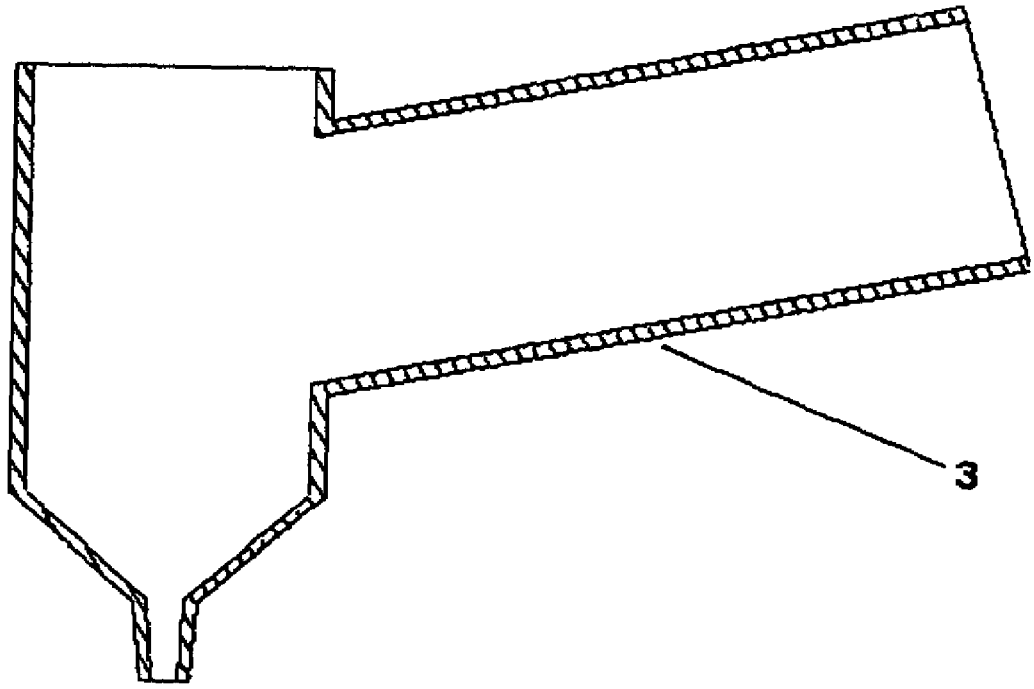
FIG. 4 is a cross-sectional view of the receptacle support shown in FIG. 3.
Figure 5:
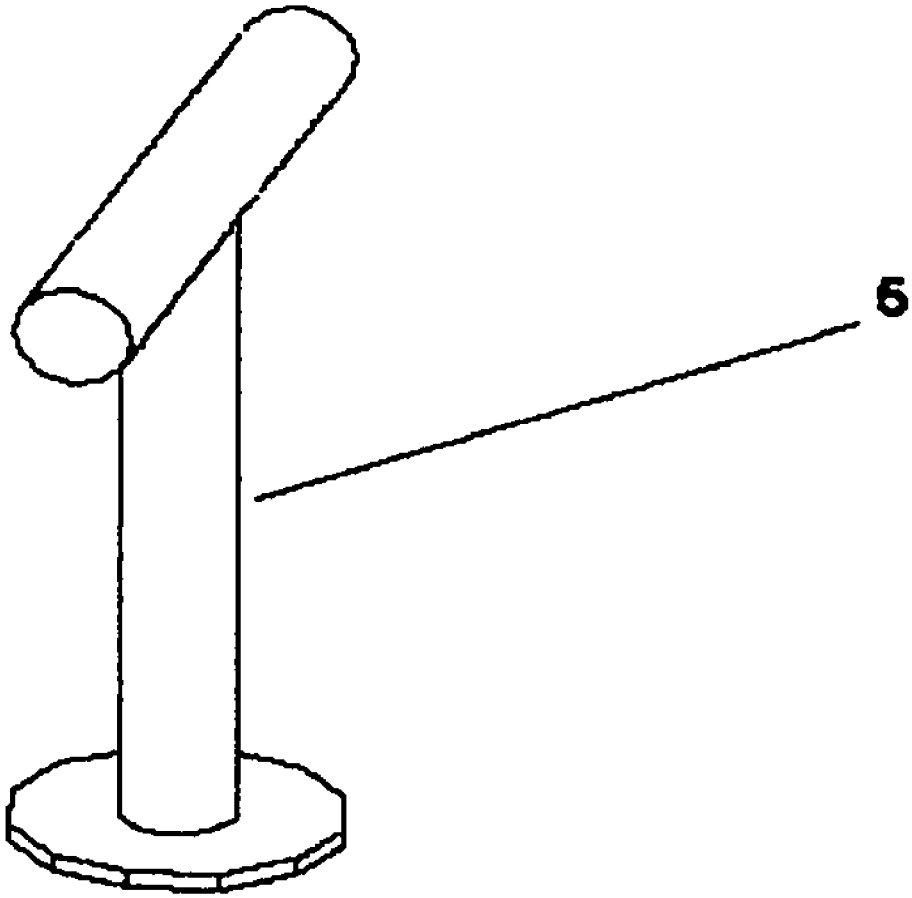
FIG. 5 is a perspective view of the receptacle support syringe type plunger.

The receptacle support(s) 3 is comprised of two hollow cylinders joined at nearly right angles as shown in FIG. 3 and sectional view FIG. 4. The nearly horizontal cylinder is sized such that it fits a variety of receptacles. The vertical cylinder incorporates a small nozzle at the bottom for the purpose of retaining viscous fluids and allowing them to be easily introduced into a second receptacle. The vertical cylinder also accepts plunger 5 so that their diameters fit snuggly together in a syringe-type fashion.

Figure 8:
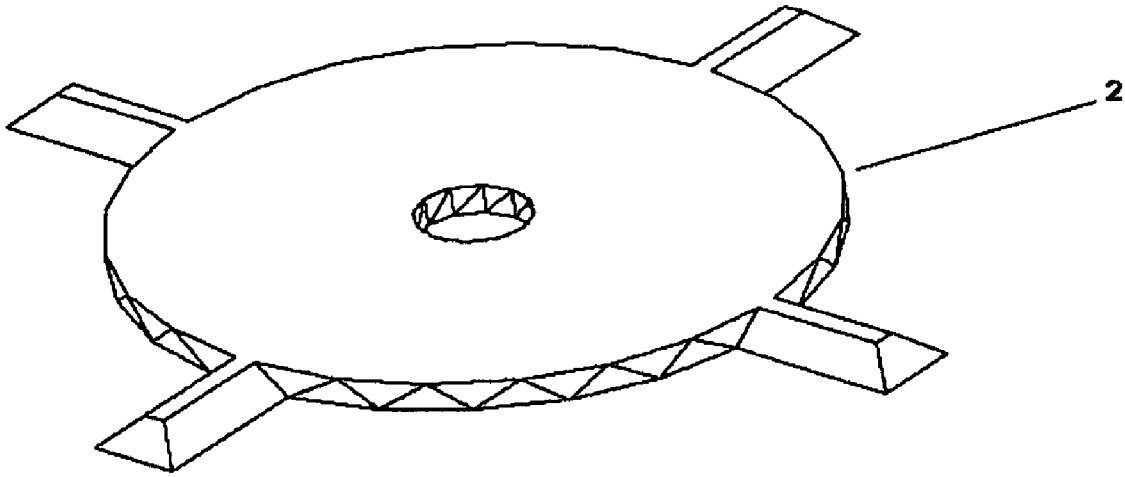
FIG. 8 is a perspective view of the receptacle support retainer.

The receptacle support retainer (FIG. 2, Item 2 and FIG. 8) is essentially a disk with "fingers" that emminate outward from the edge of the disk and are long enough to contact and retain the bottom lip of the receptacle support(s). The receptacle support retainer is positioned on the motor driveshaft and retains each receptacle support at its nearly horizontal cylinder bottom lip. When the wing nut (FIG. 2, Item 1) is tightened over the receptacle support retainer, it provides sufficient force to retain the receptacle support firmly against the receptacle support frame 4, and the receptacle support frame 4 onto the motor 6 driveshaft. The motor 6 is mounted in base frame 10 and provides rotation to the receptacle support frame 4, receptacle support(s) 3, receptacle support retainer 8 and wing nut 1.

The safety shroud 8, is mounted on the circumference of base frame 10 and encloses the rotating components to protect the user from becoming entangled in them during operation. The safety shroud incorporates a hinged door 9, to provide easy access to the base frame 10 shelf 13 and to rotating components for disassembly. It is intended for the safety shroud 8 to be installed and the door 9 closed during operation of the invention. The safety lid 7, fits from the top onto the safety shroud 8, and is removable. The safety lid 7 encloses the rotating components from the top to protect the user from becoming entangled in them during operation. The safety lid 7 incorporates a handle in the center to provide for easy access to the receptacle support frame 4, receptacle supports 3, receptacle support retainer 2, wing nut 1, and motor 6. It is intended for the safety lid 7 to be installed during operation.

To operate the embodiment shown in FIGS. 1-8, the user first removes the safety lid 7. One or more partially or completely filled bottle(s) or other receptacle(s) are inserted into the open end of one of the receptacle support(s) 3 until it stops. Centrifugal force will retain the bottle or other receptacle in the receptacle support 3 during operation. The wing nut 1 is checked to ensure it is tight against the receptacle support retainer 2 and that the receptacle support retainer is properly contacting each of the receptacle supports. The safety lid 7 is then installed onto the safety shroud 8 and the door 9 is closed.

The operator then plugs in the motor 6 electrical cord into an electrical outlet and activates the electrical switch to the "on" position. The receptacle support frame 4, receptacle support(s) 3 are brought up to rotational speed to impose a centrifugal force on the receptacle(s) and their contents sufficient to cause the contents to exit the receptacle(s) in a radially outward direction and collect in the hollow vertical cylinder of the receptacle support(s) 3. The motor 6 is then deactivated by moving the electrical switch to the "off" position. Once all internal rotation stops, the safety lid 7 is removed and each receptacle is removed from the receptacle support(s). The door 9 is opened and a second receptacle is placed on the base frame 10 shelf 13 underneath a receptacle support.

The plunger 5 is then inserted from the top and into each receptacle support in order to cleanly and efficiently force the contents from each receptacle support 3 and into the receptacle below. The receptacle support frame 4 may be rotated by hand in order to position each receptacle support 3 over the receptacle below.

All rotating components, except the motor 6, of the embodiment depicted in FIGS. 1 through 8 are easily disassembled for cleaning or storage by removing the safety lid 7 and wing nut 1. Once this is done, the receptacle support retainer 2, receptacle support(s) 3, and receptacle support frame are removed by sliding them off of the motor 6 drive shaft. The receptacle support(s) 3 are also easily removed from the receptacle support frame 4.

Figure 6:
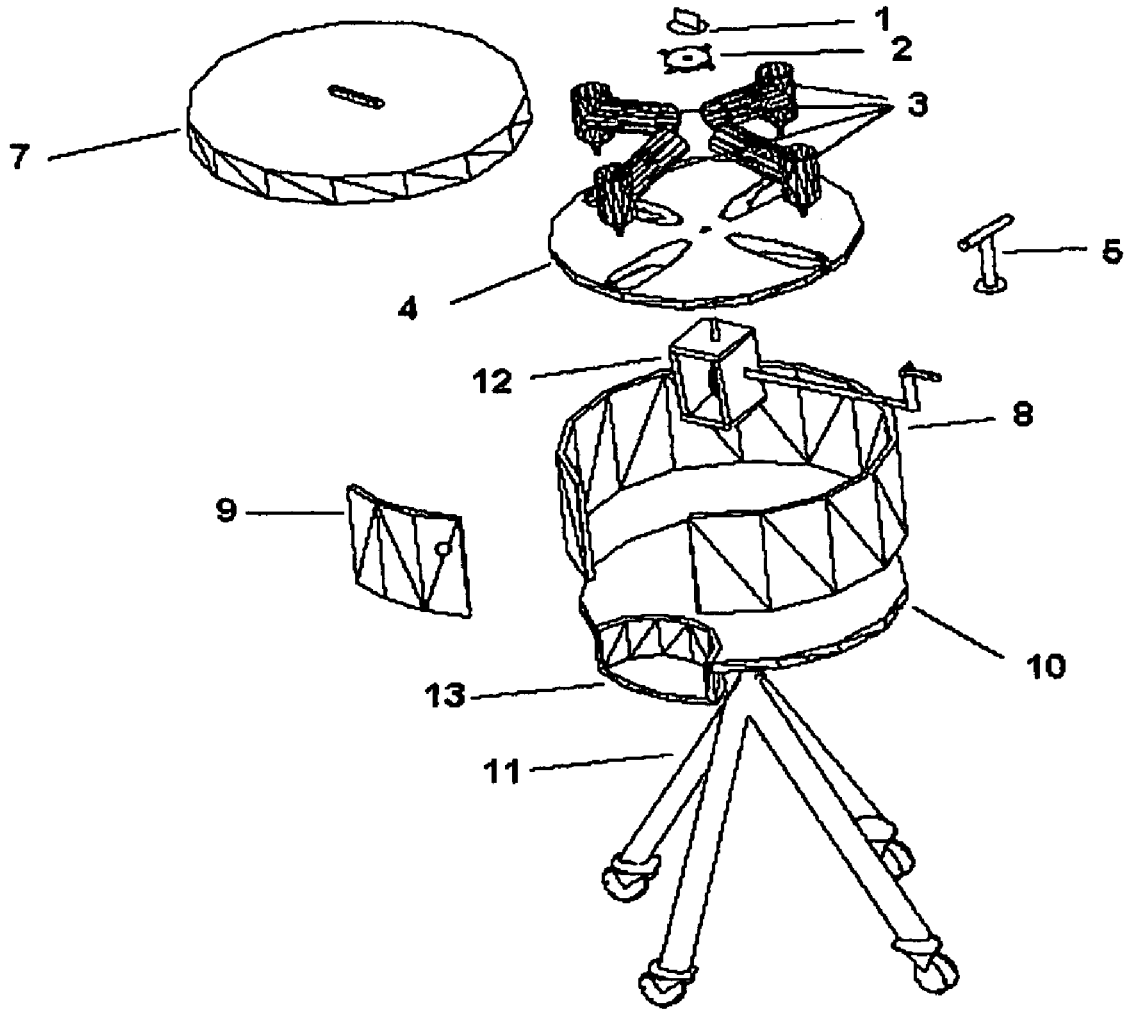
FIG. 6 is an exploded perspective view of an alternative drainer assembly utilizing a manual drive system.
Figure 7:
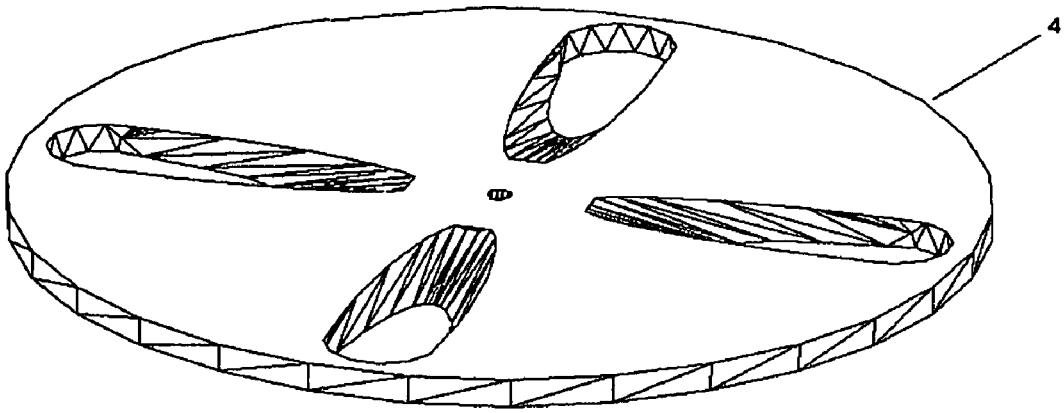
FIG. 7 is a perspective view of the rotating receptacle support frame.

An alternate configuration of the invention replaces the motor (FIG. 2, Item 6) with a manual gearbox driven by a hand crank (FIG. 6, Item 12). Operation of this embodiment is changed only by the fact that all internal rotation is manually driven by hand.

While the preferred embodiments have been fully described and depicted for the purposes of explaining the principles of the present invention, it will be appreciated by those skilled in the art that modifications and changes may be made thereto without departing from the spirit and scope of the invention set forth in the appended claims.

What is claimed is:

1. An apparatus for draining fluid from a receptacle, comprising: a base frame; a rotating receptacle support frame coupled to a drive assembly disposed on said base frame; at least one receptacle support which is mounted into rotating said receptacle support frame, wherein at least one receptacle support can securely retain at least one receptacle for rotating at high rate; a receptacle support retainer; and a plunger; wherein said at least one receptacle support comprises: two tubular sections, wherein the first tubular section is joined into the side of a second tubular section at about a perpendicular angle, and wherein the first tubular section is for supporting the receptacle so that its contents may be emptied into the second tubular section from the side, and wherein said second tubular section is for receiving the contents of the receptacle and for enabling said plunger to enter from the top of said second tubular section and force the contents out of the bottom of the second tubular section, and wherein said second tubular section incorporates a reduced area nozzle that allows the contents to be easily transferred to another receptacle.

2. An apparatus as set forth in claim 1, wherein said base frame comprises: a base plate which incorporates a shelf for supporting one or more receptacles for the purpose of receiving the contents from said at least one receptacle support; said drive assembly comprising an electric motor and a vertical drive shaft mounted on said base plate; a thumb screw for securing said support frame onto said drive shaft and for securing said retainer to hold said at least one receptacle support on said support frame; and a plurality of support legs mounted on caster wheels coupled to said base frame.

3. An apparatus as set forth in claim 1, further comprising a safety shroud on the base frame.

4. An apparatus as set forth in claim 3, wherein said safety shroud has a hinged door.

5. An apparatus as set forth in claim 3, further comprising a lid on a top portion of said safety shroud.

6. An apparatus as set forth in claim 1, wherein said drive assembly comprises a gearbox driven by a hand crank.

* * * * *